US012663012B1

(12) United States Patent
Liu

(10) Patent No.: US 12,663,012 B1
(45) Date of Patent: Jun. 23, 2026

(54) ROTARY FAN STRUCTURE

(71) Applicant: PAN AIR ELECTRIC CO., LTD., Taichung City (TW)

(72) Inventor: Ching-Wen Liu, Taichung City (TW)

(73) Assignee: PAN AIR ELECTRIC CO., LTD., Taichung City (TW)

( * ) Notice: Subject to any disclaimer, the term of this patent is extended or adjusted under 35 U.S.C. 154(b) by 0 days.

(21) Appl. No.: 19/337,949

(22) Filed: Sep. 24, 2025

(51) Int. Cl.
*F04D 25/08* (2006.01)
*F04D 19/00* (2006.01)
*F04D 29/64* (2006.01)

(52) U.S. Cl.
CPC ..... *F04D 25/088* (2013.01); *F04D 19/002* (2013.01); *F04D 29/646* (2013.01)

(58) Field of Classification Search
CPC ..... F04D 25/088
See application file for complete search history.

(56) References Cited

FOREIGN PATENT DOCUMENTS

| | | | | |
|---|---|---|---|---|
| CN | 206890488 U | * | 1/2018 | |
| CN | 214533611 U | * | 10/2021 | |
| EP | 0553387 A1 | * | 8/1993 | ..... F21V 33/0096 |
| WO | WO-2021149070 A1 | * | 7/2021 | ..... F04D 25/088 |

* cited by examiner

*Primary Examiner* — Courtney D Heinle
*Assistant Examiner* — Danielle M. Christensen
(74) *Attorney, Agent, or Firm* — Ying-Ting Chen

(57) ABSTRACT

A rotary fan structure is provided. The rotary fan structure includes: a ceiling mount structure; a motor, disposed on the ceiling mount structure; a bearing, disposed on the ceiling mount structure; a slip ring set, including an outer ring member and an inner ring member, and the inner ring member having a fan power supply wire; a rotary shaft, and the inner ring member being sleeved on the rotary shaft; a coupling, disposed on the bearing and located between the motor and the rotary shaft, a motor axis being disposed on the coupling, and one end of the rotary shaft being connected to the coupling; a fan coupling assembly, disposed on one end of the rotary shaft away from the motor.

7 Claims, 7 Drawing Sheets

ROTARY FAN STRUCTURE

FIELD OF THE DISCLOSURE

The present disclosure relates to a rotary fan structure, and more particularly to a structure that enables the fan to rotate continuously 360 degrees.

BACKGROUND OF THE DISCLOSURE

A fan is a device that enables airflow circulation and reduces perceived temperature. It is often used in hot indoor environments and stuffy environments to improve physical comfort. It consumes much less energy than air conditioners, so that it remains a very common device even with the development of technology.

The main structure of a fan generally includes a motor, fan blades, and a base for supporting the motor. The fan blades are disposed on the motor axis so that the motor drives the fan blades to rotate and thus bring out airflow. For the fan structure improvement, in order to increase the range of use of the fan, a rotary mechanism is often applied between the base and the motor so that the direction of the fan blades can rotate back and forth within a certain angle during use.

However, the conventional fan rotary mechanism still has shortcomings. Due to its rotation range being limited to a certain angle, a more common practice is to place the fan in a corner to blow the wind to the entire range of the target area as much as possible. Specifically, when the fan directs the airflow to the corners that are far away, the airflow is significantly weakened. Moreover, due to the limited fan's rotating range, placing the fan in the center of the target area is not an ideal approach.

In view of the above-mentioned difficulties, there is a need to improve the rotating range of conventional fans.

SUMMARY OF THE DISCLOSURE

The structure enables the fan to achieve continuous 360-degree rotation. Even if the fan is disposed in the center of the target area, it still generates airflow to the surrounding areas.

In order to achieve the above-mentioned objective, the present disclosure provides a rotary fan structure. The rotary fan structure includes: a ceiling mount structure; a motor, disposed on the ceiling mount structure; a bearing, disposed on the ceiling mount structure; a slip ring set, including an outer ring member and an inner ring member, and the inner ring member having a fan power supply wire; a rotary shaft, and the inner ring member being sleeved on the rotary shaft; a coupling, disposed on the bearing and located between the motor and the rotary shaft, a motor axis being disposed on the coupling, and one end of the rotary shaft being connected to the coupling; a fan coupling assembly, disposed on one end of the rotary shaft away from the motor.

In certain embodiments, the ceiling mount structure includes a main mounting member and a carrying member connected to each other; wherein the carrying member is located below the main mounting member, the bearing is disposed on the carrying member, the motor is disposed on the main mounting member, and the coupling is located between the main mounting member and the carrying member.

In certain embodiments, the carrying member has a bottom convex portion, a receiving hole is provided in the bottom convex portion, and the bearing is arranged in the receiving hole.

In certain embodiments, a terminal block is arranged outside of the ceiling mount structure.

In certain embodiments, the main support member has a wing portion, a first connecting piece portion, and a second connecting piece portion; wherein the wing portion extends laterally at a top of the main support member, and the first connecting piece portion and the second connecting piece portion are spaced apart and bent downwardly from an end of the wing portion.

In certain embodiments, an angle between the first connecting piece and the second connecting piece is 150 degrees to 160 degrees.

In certain embodiments, the fan coupling assembly includes a main support member and an auxiliary rod; wherein one end of the main support member is connected to the rotary shaft, and the other end of the main support member has a connecting hole; wherein the main support member has a wire hole communicating the connecting hole with an external space; wherein one end of the auxiliary rod is inserted into the connecting hole; wherein the power supply wire partially passes through the wire hole and partially is located in the auxiliary rod.

In summary, it can be seen that the motor axis of the present disclosure is connected to the rotary shaft by the coupling, and the structure includes a slip ring set. The inner ring member is disposed on the rotary shaft. Therefore, in actual use, the outer ring member is electrically connected to an external power source (utility power, and a transformer can be configured according to different voltage requirements) via a power cord. Further, the inner ring member is electrically connected to the fan via the power supply wire, and the outer ring member utilizes the characteristics of the slip ring set to transmit the power from the external power supply to the inner ring member and output it to the fan via the power supply wire. Specifically, when the rotary shaft drives the fan to rotate through the fan coupling assembly, since the fan is not directly connected to the power cord, the power cord will not interfere with the fan's rotation, thereby achieving the fan's continuous 360-degree rotation function.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
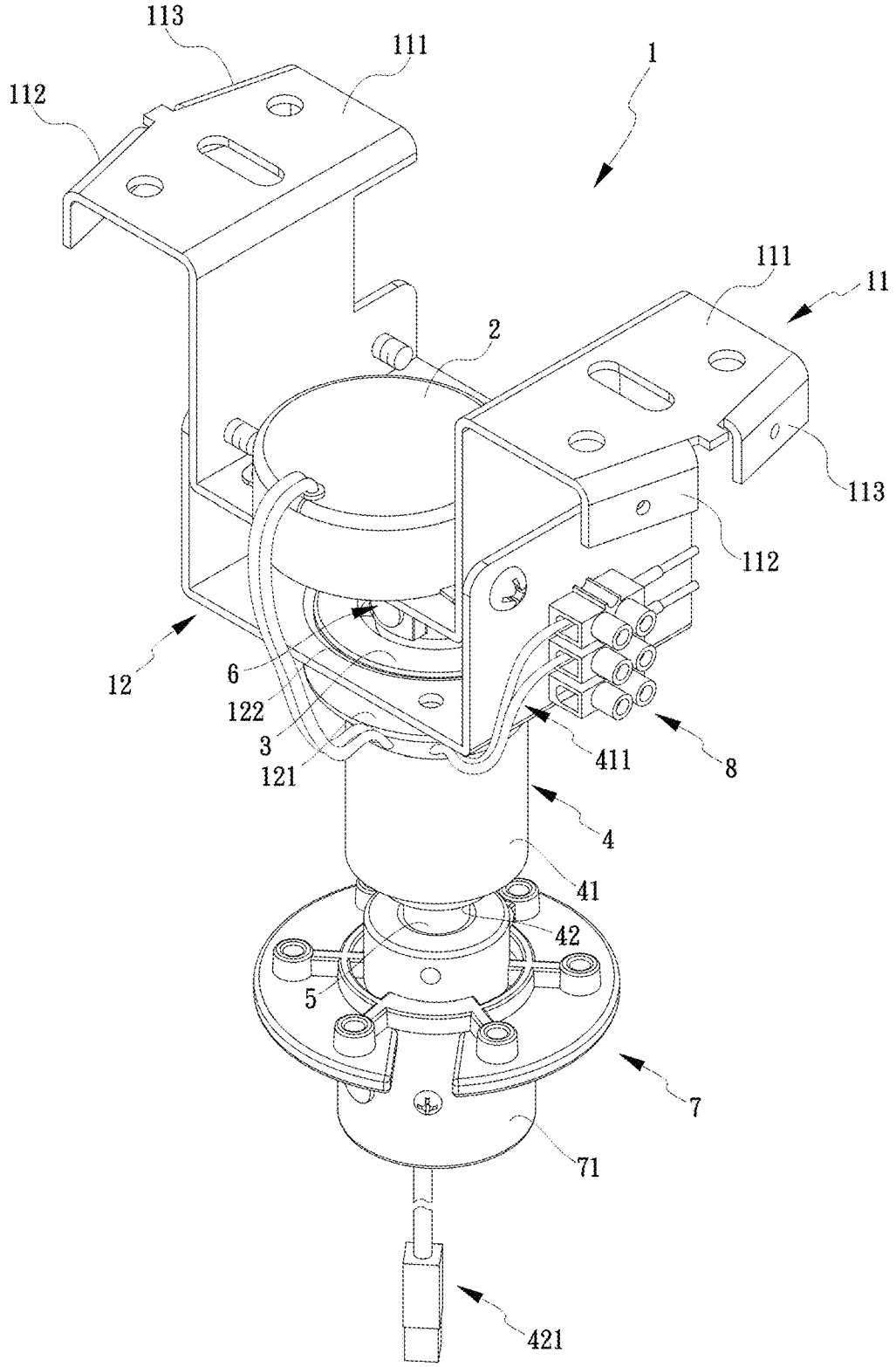
FIG. 1 is a perspective schematic view of one embodiment of the present disclosure.
Figure 2:
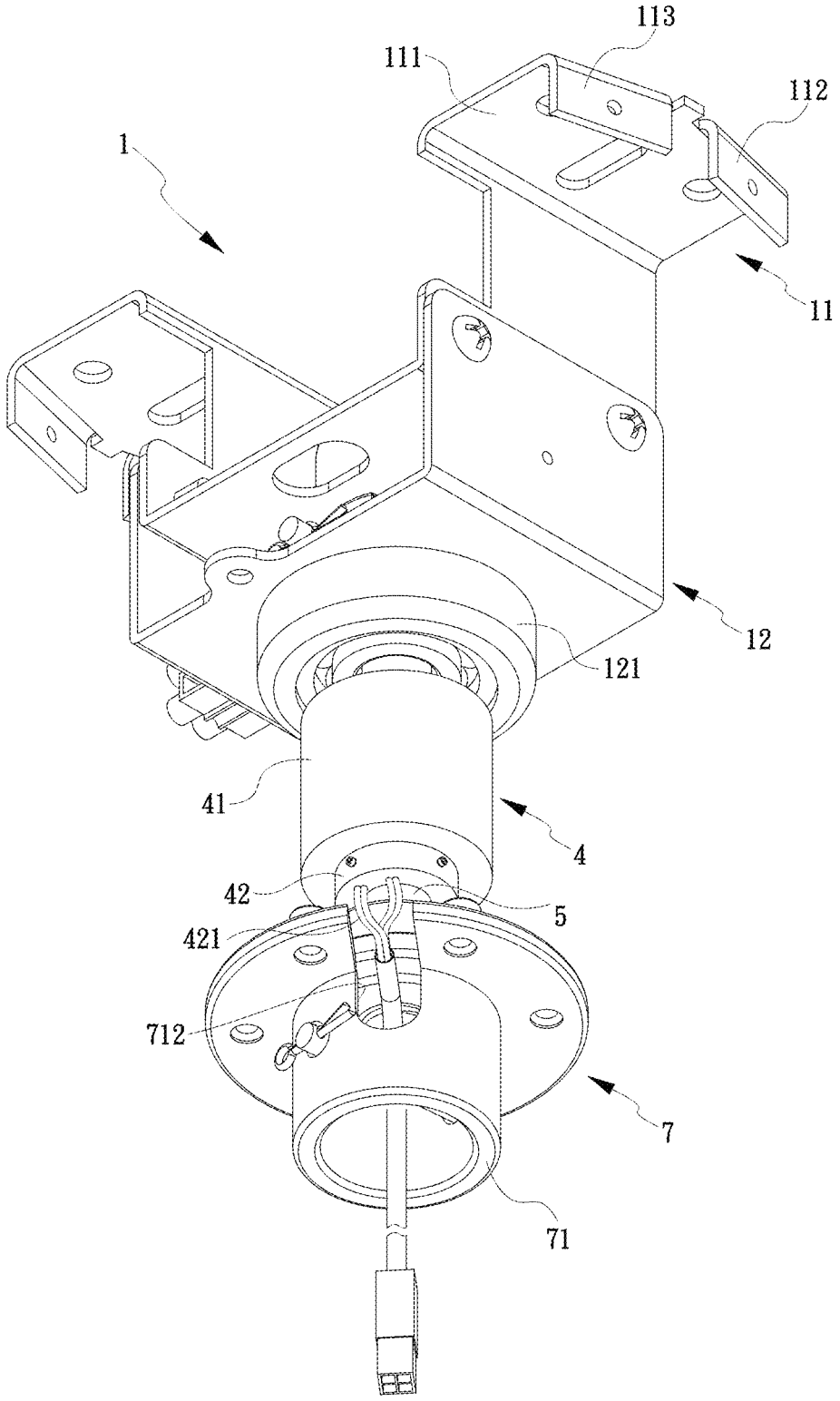
FIG. 2 is another schematic perspective view of another angle of the present disclosure.
Figure 3:
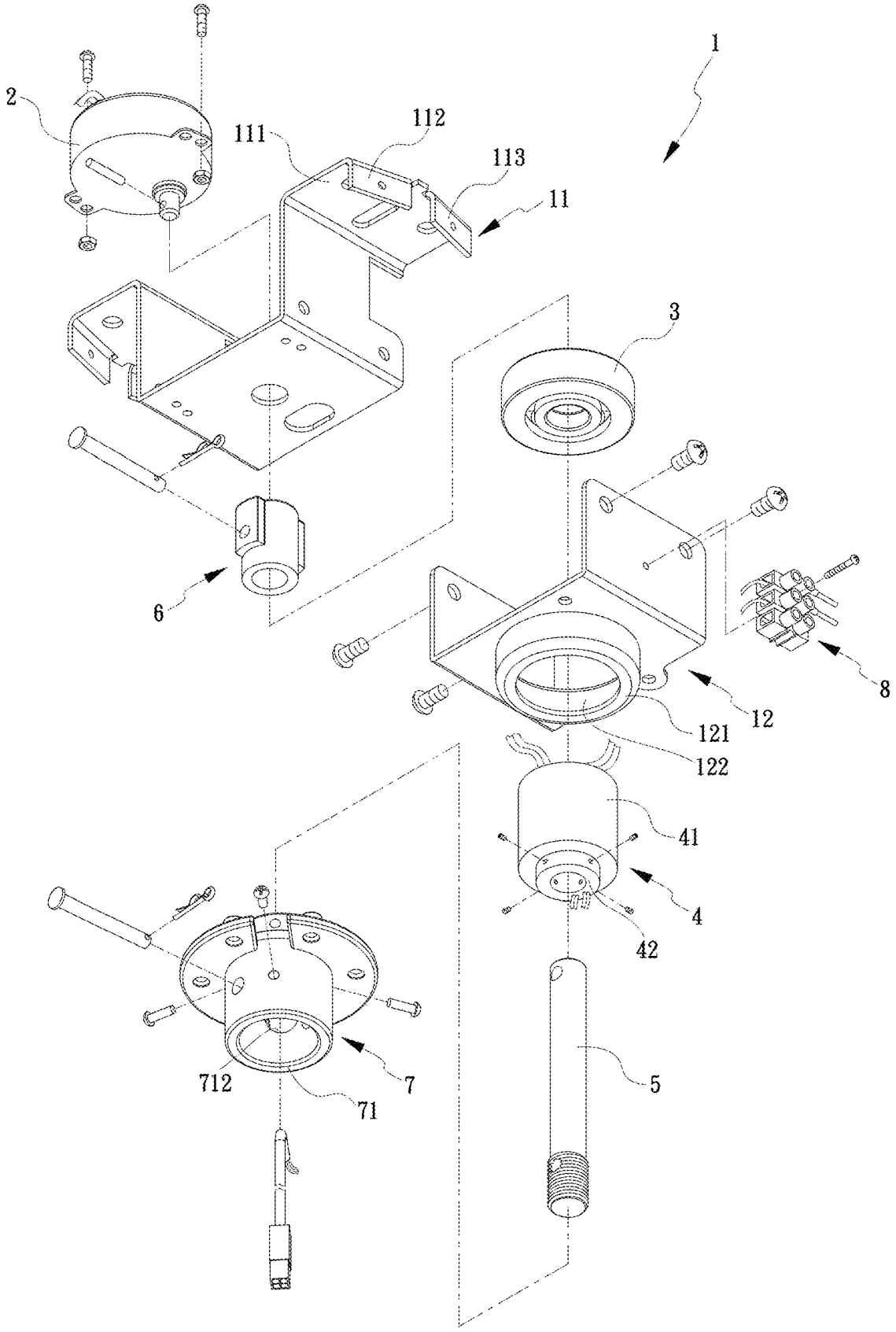
FIG. 3 is an exploded schematic view of the structure of the present disclosure.

For the sake of a detailed understanding of the embodiments of the present disclosure, the description can be read in conjunction with the drawings. As shown in FIG. 1 to FIG. 3, a rotary fan structure is provided. The rotary fan structure includes: a ceiling mount structure 1, a motor 2, a bearing 3, a slip ring set 4, a rotary shaft 5, a coupling 6, and a fan coupling assembly 7. The motor 2 is disposed on the ceiling mount structure 1. The bearing 3 is disposed on the ceiling mount structure 1. The slip ring set 4 includes an outer ring member 41 and an inner ring member 42, and the inner ring member 42 has a fan power supply wire. The inner ring member 42 is sleeved on the rotary shaft 5. The coupling 6 is disposed on the bearing 3 and located between the motor 2 and the rotary shaft 5. A motor axis of the motor 2 is disposed on the coupling 6, and one end of the rotary shaft 5 is connected to the coupling 6. The fan coupling assembly 7 is disposed on one end of the rotary shaft 5 away from the motor 2.

Figure 4:
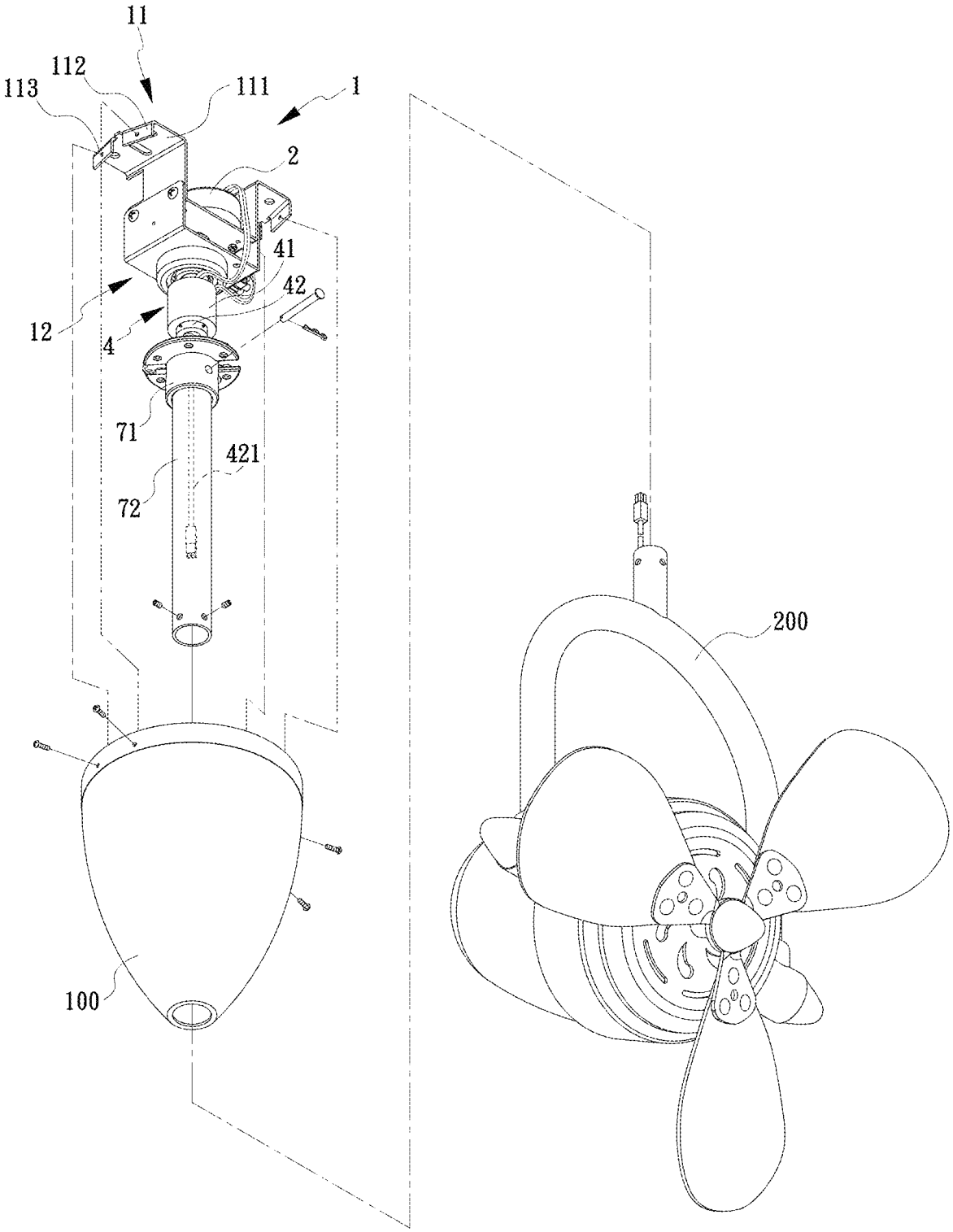
FIG. 4 is an exploded schematic view of the housing, the fan, and the structure of the present disclosure.
Figure 5:
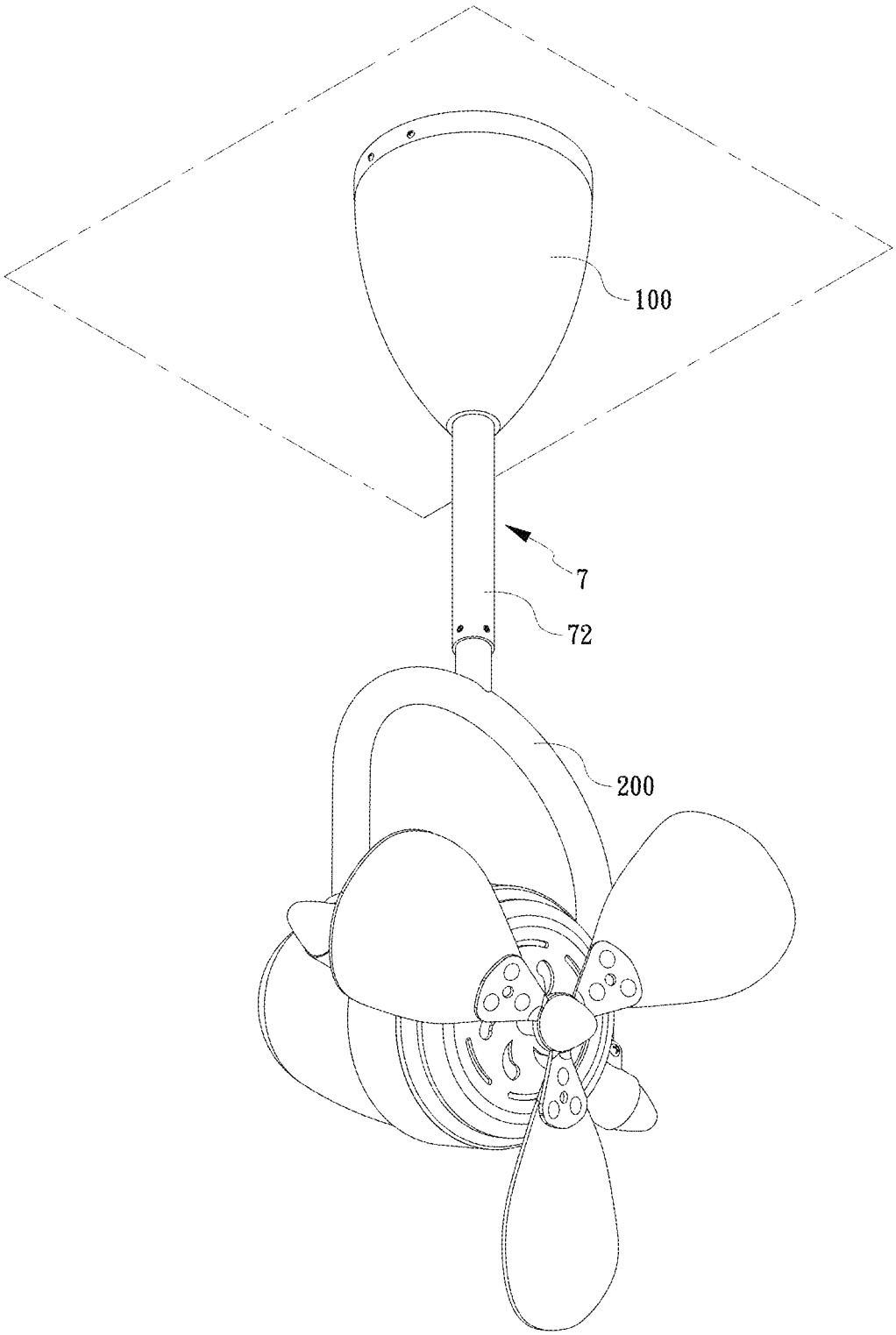
FIG. 5 is an assembled schematic view of the housing, the fan and the structure of the present disclosure.
Figure 6:
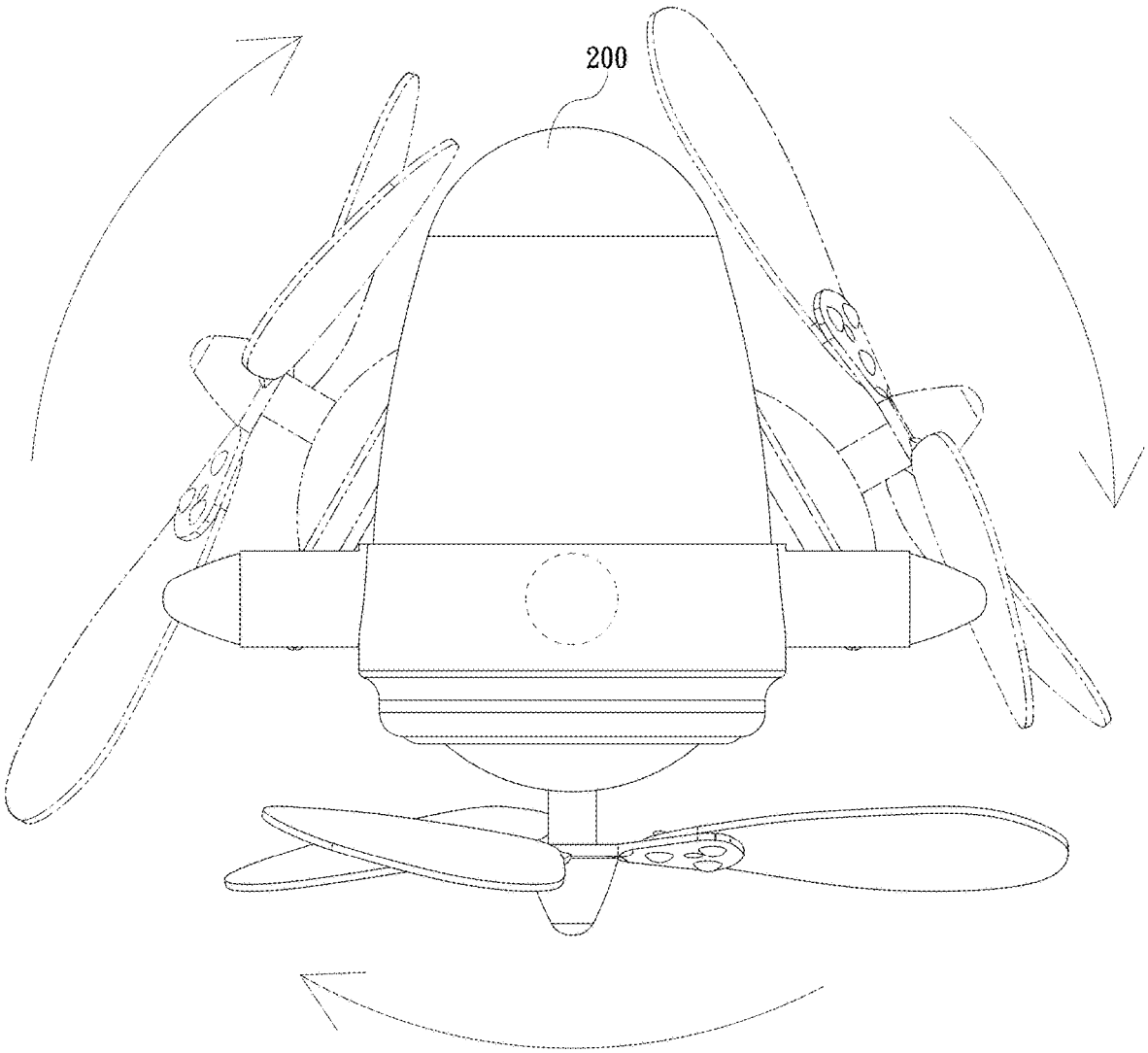
FIG. 6 is a schematic top view of the structure of the present disclosure when the fan rotates.

The embodiments of the present disclosure are more particularly described in the following description. In practice, the structure of the present disclosure is to mount on the ceiling 300 through the ceiling mount structure 1, the outer ring member is electrically connected to an external power source (utility power, and a transformer can be configured according to different voltage requirements) via a power cord. The motor 2 is electrically connected to the outer ring member 41 to obtain power, and the inner ring member 42 is electrically connected to the fan 200 via the power supply wire 421. The fan 200 is fixed to the fan coupling assembly 7. In one embodiment of the present disclosure, a housing 100 is disposed around the ceiling mount structure 1, as shown in FIG. 4 and FIG. 5. Therefore, the situation that the wires are exposed and unsightly can be avoided. When the present disclosure is installed, the fan 200 can achieve a continuous 360-degree rotation function, as shown in FIG. 6.

Furthermore, the structure of the present disclosure is applied to the fan 200, and the principle of the fan 200 achieving a continuous 360-degree steering function is described in detail. The present disclosure utilizes the characteristics of the slip ring set 4 (brush collector), the outer ring member 41 transmits the power from the external power supply to the inner ring member 42 and outputs it to the fan 200 via the power supply wire 421. Specifically, when the rotary shaft drives the fan 200 to rotate through the fan coupling assembly 7, since the fan 200 is not directly connected to the power cord 411, the power cord 411 will not interfere with the rotation of the fan 200, thereby allowing the fan to continuously rotate 360 degrees.

Further details of the ceiling mount structure 1 of the present disclosure are provided. The ceiling mount structure 1 includes a main mounting member 11 and a carrying member 12 connected to each other. The carrying member 12 is located below the main mounting member 11, the motor 2 is disposed on the main mounting member 11, and the coupling 6 is located between the main mounting member 11 and the carrying member 12. Moreover, the carrying member 12 has a bottom convex portion 121, a receiving hole 122 is provided in the bottom convex portion 121, and the bearing 3 is arranged in the receiving hole 122. This way, a suitable distance between components can be provided, thus unnecessary friction between components during operation can be avoided.

In certain embodiments, a terminal block 8 is disposed outside of the ceiling mount structure 1. The terminal block 8 is provided to facilitate the operator to electrically connect the external power supply to the power cord 411 easily.

Figure 7:
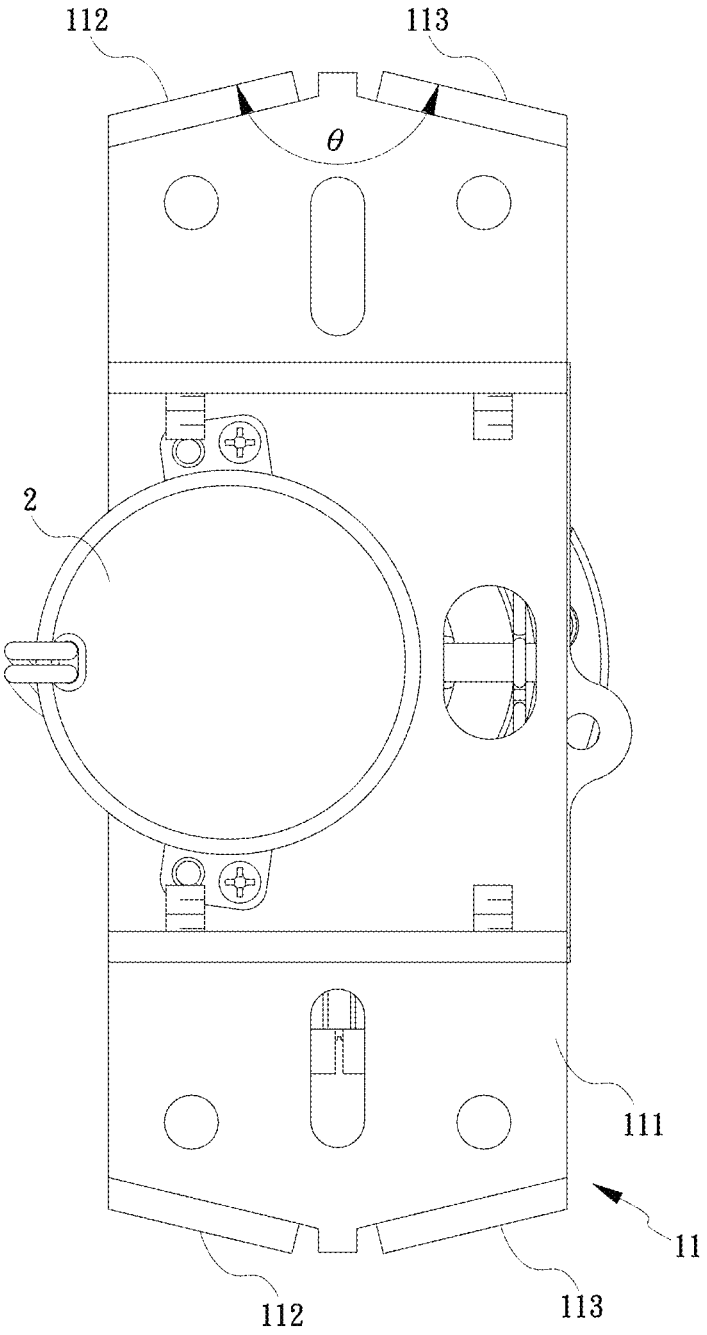
FIG. 7 is a planar schematic top view of the present disclosure.

In certain embodiments, the main support member 11 has a wing portion 111 extending laterally at a top of the main support member, a first connecting piece portion 112, and a second connecting piece portion 113 that are spaced apart and bent downwardly from an end of the wing portion 111. As shown in FIG. 7, an angle between the first connecting piece 112 and the second connecting piece 113 is 150 degrees to 160 degrees. Preferably, the angle is 157 degrees. The wing portion 111 allows the ceiling mount structure 1 to be firmly fixed on the ceiling 300, and it is also convenient to place a layer between the wing portion 111 and the ceiling 300 to avoid leaving marks on the ceiling 300 during the fastening process of the ceiling mount structure 1. In addition, the first connecting piece 112 and the second connecting piece 113 are used to dispose the housing 100, and the angle as mentioned above 0 enables the circular housing 100 of this embodiment to be disposed easily.

In certain embodiments, the fan coupling assembly 7 includes a main support member 71 and an auxiliary rod 72. In detail, one end of the main support member 71 is connected to the rotary shaft 5, and the other end of the main support member 71 has a connecting hole 711. The main support member 71 has a wire hole 712 spatially communicating the connecting hole 711 with an external space. Further, one end of the auxiliary rod 72 is inserted into the connecting hole 711. Moreover, the power supply wire 421 partially passes through the wire hole 712 and partially is located in the auxiliary rod 72. The auxiliary rod 72 can cover the part of the assembly structure between the fan coupling assembly 7 and the fan 200, so that the whole structure looks neater and more beautiful.

What is claimed is:

1. A rotary fan structure, comprising:

a ceiling mount structure;

a motor, disposed on the ceiling mount structure;

a bearing, disposed on the ceiling mount structure;

a slip ring set, including an outer ring member and an inner ring member; wherein the inner ring member has a power supply wire;

a rotary shaft, the inner ring member being sleeved on the rotary shaft;

a coupling, disposed on the bearing and located between the motor and the rotary shaft; wherein a motor axis is disposed on the coupling, and one end of the rotary shaft is connected to the coupling; and a fan coupling assembly, disposed on one end of the rotary shaft away from the motor.

2. The rotary fan structure according to claim 1, wherein the ceiling mount structure includes a main mounting member and a carrying member connected to each other; wherein the carrying member is located below the main mounting member, the bearing is disposed on the carrying member, the motor is disposed on the main mounting member, and the coupling is located between the main mounting member and the carrying member.

3. The rotary fan structure according to claim 2, wherein the carrying member has a bottom convex portion, a receiving hole is provided in the bottom convex portion, and the bearing is arranged in the receiving hole.

4. The rotary fan structure according to claim 2, wherein the main mounting member has a wing portion, a first connecting piece portion and a second connecting piece portion; wherein the wing portion extends laterally at a top of the main mounting member, and the first connecting piece portion and the second connecting piece portion are spaced apart and bent downwardly from an end of the wing portion.

5. The rotary fan structure according to claim 4, wherein an angle between the first connecting piece and the second connecting piece is 150 degrees to 160 degrees.

6. The rotary fan structure according to claim 1, wherein a terminal block is arranged outside of the ceiling mount structure.

7. The rotary fan structure according to claim 1, wherein the fan coupling assembly includes a main support member and an auxiliary rod; wherein one end of the main support member is connected to the rotary shaft, and the other end of the main support member has a connecting hole; wherein the main support member has a wire hole communicating the connecting hole with an external space; wherein one end of the auxiliary rod is inserted into the connecting hole; wherein the power supply wire partially passes through the wire hole and partially is located in the auxiliary rod.

* * * * *